US005618648A

United States Patent [19]

Horikoshi et al.

[11] Patent Number: 5,618,648

[45] Date of Patent: Apr. 8, 1997

[54] TONER BINDER, TONER, ELECTROPHOTOGRAPHIC METHOD AND APPARATUS THEREFOR

[75] Inventors: Yuzo Horikoshi; Norio Sawatari; Takeshi Ogino, all of Kawasaki; Hiroaki Naito, Kato-gun; Makoto Koshi, Kawasaki; Kazuhiko Kido, Kawasaki; Takashi Yamamoto, Kawasaki; Eiji Sakurai, Kawasaki; Yoshimichi Katagiri, Kawasaki; Masatoshi Maruyama, Tokyo; Hidenori Nitta, Tokyo; Sonoo Matsuoka, Tokyo, all of Japan

[73] Assignees: Fujitsu Limited, Kawasaki; Nippon Carbide Industries, Co., Inc., Tokyo, both of Japan

[21] Appl. No.: 501,444

[22] Filed: Jul. 12, 1995

[30] Foreign Application Priority Data

Sep. 19, 1994 [JP] Japan ..... 6-223650

[51] Int. Cl.$^6$ ..... G03G 9/087

[52] U.S. Cl. ..... 430/109; 430/126; 399/307

[58] Field of Search ..... 430/106, 109, 430/110, 126; 355/271

[56] References Cited

U.S. PATENT DOCUMENTS

| | | | |
|---|---|---|---|
| 2,297,691 | 10/1942 | Carlson . | |
| 5,234,787 | 8/1993 | Morimoto et al. | 430/109 |
| 5,466,553 | 11/1995 | Okutani et al. | 430/109 |

FOREIGN PATENT DOCUMENTS

| | | |
|---|---|---|
| 63-193155 | 8/1988 | Japan . |

*Primary Examiner*—John Goodrow
*Attorney, Agent, or Firm*—Armstrong, Westerman, Hattori, McLeland & Naughton

[57] ABSTRACT

A toner binder is disclosed which comprises a polyester resin in which an aliphatic hydrocarbon chain terminated with an ester and/or an ether bond to the aliphatic group contains a constituent element consisting of ethylene in an amount of from 1 to 5 wt % based on the total weight of the resin. Further disclosed is a toner binder using both of a crosslinked polyester having a peak molecular weight of 10,000 or less and a linear polyester having a peak molecular weight of 8,000 or more as binder resins, the peak molecular weight of the linear polyester being greater than the peak molecular weight of the crosslinked polyester.

23 Claims, 4 Drawing Sheets

TONER BINDER, TONER, ELECTROPHOTOGRAPHIC METHOD AND APPARATUS THEREFOR

BACKGROUND OF THE INVENTION

1. Field of the Invention

The present invention relates to a toner binder, a toner, an electrophotographinc printing method and an apparatus therefor. More specifically, the present invention relates to an improvement in a toner binder for flash fixing which is superior in flash fixability, void resistance and environmental electrostatic charging stability and, especially, which does not generate an unpleasant odor during flash fixing.

2. Description of the Invention

Electrophotography has been conventionally known to use a system such as that described in U.S. Pat. No. 2,297,691, where a photoconductive insulator (e.g., a photoconductive drum) is commonly used, a uniform electrostatic charge is applied to the photoconductive insulator by, for example, a corona discharge, a light image is irradiated on the photoconductive insulator by various means to form an electrostatic latent image, the latent image is developed and visualized using fine particles called toner and after the toner image is transferred, if desired, to paper or the like, the toner image is fixed onto the recording medium such as paper by means of pressing, heating, exposure to solvent vapor or irradiation by light to obtain a printed matter.

The toner used for developing the electrostatic latent image is conventionally produced by dispersing a coloring agent such as carbon black in a binder resin comprising a natural or synthetic polymer material and finely granulating the obtained dispersion into particles of approximately 5 to 20 μm in size. The toner may be used in the development of an electrostatic latent image as the toner by itself or as a mixture with a carrier such as iron powder or glass beads. In the case where iron powder or other ferromagnetic powder is used as the carrier, the development is conducted in such a manner that the developing agent consisting of a toner and a carrier is mixed and stirred in a developing apparatus to be charged with frictional electrification, a magnet roll in the developing apparatus is rotated to form a magnetic brush, the formed magnetic brush is transported to the electrostatic latent image portion on the photoconductive sensitized material as the magnet roll rotates and only the charged toner is attached onto the latent image due to the electrical attraction force. After the development, the developing agent reduced in the toner density is replenished by new toner, to maintain the toner density constant, and can be repeatedly used.

On the other hand, the toner powder image formed on the photosensitive drum is transferred onto a recording medium (e.g., paper) by corona transfer or roller transfer. The toner powder image transferred to the recording medium is adhered to the paper in the state of powder forming an image, where if it is rubbed by, for example, a finger, the powder image is damaged. In order to fix the toner powder image on the recording medium, the powder image must be melted to fix it to the recording medium and one of the various methods described above is used therefor. Among these methods, flash fixing as a representative example of photofixing is conducted by a flash of light from discharge tube such as a xenon flash lamp and is characterized as follows:

1) due to non-contact fixing, the resolution of the developed image is not deteriorated,
2) the stand-by time after a power source is turned on is not required and a quick start can be realized,
3) even when the recording paper is jammed in the fixing device due to a system failure, ignition is not generated, and
4) fixing is possible irrespective of the material or thickness of a recording paper such as pasted paper, preprint paper or other papers different in thickness.

The toner is fixed to the recording paper by flash fixing through the following procedure. As described above, the toner image adheres to the recording paper in the state of powder forming an image when it is transferred to the recording paper but the powder image is readily damaged by rubbing by, for example, a finger. When a flash of light from a discharge tube such as a xenon flash lamp is irradiated thereon, the toner absorbs the energy of the flash of light to raise the temperature of the toner and thereby the toner is softened and melted to firmly adhere to the recording paper. After the flash of light finishes, the temperature falls to solidify the image and a fixed image is obtained, thus accomplishing the fixing, and the fixed image firmly adhered to the recording paper cannot be damaged even if it is rubbed by, for example, a finger.

Referring to FIGS. 1A to 1C, it is important in flash fixing that the toner 1 is melted and firmly adheres to the recording paper 2 and therefore, the toner must be melted by absorbing from the flash of light sufficient light energy which must include the energy used for melting the toner and the heat energy diffusing outside the toner not contributing to the increase of temperature. Accordingly, if the light energy given is insufficient, the toner cannot be melted sufficiently and as a result, the fixing is not satisfactory. On the other hand, if the light energy 3 is too high, the viscoelasticity of toner 1 is abruptly lowered (FIG. 1B). At this time, if the surface tension of the toner 1 overpowers the viscoelasticity, the toner on the printing portion aggregates and the toner moves to bring about a blank phenomenon called a void 5 on the fixed image to thereby cause a reduction in the image density (FIG. 1C). Accordingly, the toner for flash fixing must not generate voids 5 by moving the toner and in this concern, the use of a binder resin having a high viscosity when melted is needed or the use of a binder having a low surface tension when melted is demanded.

Further, as one of the important characteristics of the toner for flash fixing, the binder resin constituting the toner must melt rapidly in the course of fixing to paper and the like and after it is cooled and solidified, should show good fixation. In order to obtain such a toner property, a polymer having a low molecular weight and a low melt viscosity, generally called an oligomer (for example, having a number average molecular weight Mn of less than 1500 and a weight average molecular weight Mw of 10,000 or less) is widely used. However, since the oligomer has a low molecular weight, the glass transition point is low and therefore, there arise problems such that (1) the storage stability of toner is low, (2) blocking of toners readily occurs in a developing machine, (3) the toner is readily fused in a developing machine or a fused product (such as coarse toner) is easily formed and (4) the toner properties are liable to alter due to a change in the operating environment of the apparatus (e.g., temperature or humidity). The reason why many problems described above are caused when an oligomer having a low molecular weight is used is that if the molecular weight is made low to give the binder a low melting point, the glass transition point is also lowered, often to the room temperature level.

Therefore, in order to provide excellent flash fixability and solve the problems described above, it is necessary to optimize the melting point and the glass transition point of a binder used for the toner and it is also necessary to develop a toner comprising a binder having a low melting point and a high glass transition point.

As to the properties which the toner for flash fixing is required to have, the binder resin constituting the toner should not generate an unpleasant odor when a toner is heated to a high temperature during flash fixing. The generation of an unpleasant odor becomes a problem when the printing speed per hour is increased in flash fixing and this is because the quantity of toner melted per hour increases. For example, in the case where a printing speed is 300 mm/sec and the printing pattern is general pattern (i.e., the area ratio of the area attached by toner/the area not attached by toner is about 0.05), the quantity of toner melted per one hour is about 100 g. In an apparatus for high-speed printing at such a speed, an unpleasant odor is easily generated and becomes a serious problem in a high speed apparatus.

A technique to prevent generation of an unpleasant odor on fixing is proposed in Japanese Unexamined Patent Publication (Kokai) No. 63-193155. Japanese Unexamined Patent Publication (Kokai) No. 63193155 discloses that the generation of an unpleasant odor on fixing is ascribable to an acid monomer among residual monomers (non-reacted monomers) contained in the toner binder. It is an effective method to use a binder toner containing little of components generated by vaporization or sublimation of the above-mentioned nonreacted monomers during fixing.

However, the toner temperature in flash fixing is said to reach 200° C. or higher at the surface of the toner, as described, for example, in Japanese Unexamined Patent Publication (kokai) No. 4-56869, and under such high temperatures, an ordinary toner binder is likely to undergo thermal decomposition to generate thermally decomposed gas components which give rise to an unpleasant odor. Since the toner temperature in flash fixing reaches the thermal decomposition temperature of the binder as described above, the generation of thermally decomposed gas components cannot be avoided. Accordingly, even if the method described in Japanese Unexamined Patent Publication (kokai) No. 63-193155 is used, the fixing odor cannot be nullified and as a means to solve the problem of a fixing odor in flash fixing, methods using binders which generate a small amount of thermally decomposed gas components even when the toners are melted at high temperatures as described above or using binders which generate thermally decomposed gas components free of odor should be employed.

The object of the present invention is to provide a binder for use in a toner for flash fixing which is superior in flash fixability, void resistance, electrostatic charging stability and storage stability and, especially, which does not generate an unpleasant odor on flash fixing, a toner using the binder, an electrophotographing method using the toner and an apparatus therefor.

SUMMARY OF THE INVENTION

The present invention is to provide a toner for flash fixing comprising, as a toner binder, a polyester binder, derived from specific monomers, which is superior in flash fixability, void resistance and electrostatic charging stability and which does not generate an unpleasant odor during flash fixing. More specifically, the present invention can be realized by using a toner binder having the following features in the toner for use in an electrophotographic apparatus with a flash fixing device.

(1) A toner binder for use in an electrophotographic apparatus with a flash fixing device, which is a polyester resin comprising a constituent element consisting of ethylene as linear aliphatic hydrocarbon chains terminated by an ester bond and/or an ether bond to an aliphatic group in an amount of 1 to 5% by weight based on the total weight of the resin.

(2) A polyester resin as described in item (1) above, wherein the weight ratio of the aromatic ring content to the ethylene chain content is 50 or less.

(3) A polyester resin as described in item (1) above, wherein the polyester resin has an acid value of from 1 to 10 KOHmg/g.

(4) A polyester resin as described in item (1) above, wherein the polyester resin contains a methyl side chain in an amount of 10 parts by weight or more based on the total weight of the resin.

(5) A toner binder comprising a resin mixture containing from 50 to 90 wt % of the polyester resin described in any one of items (1) to (4) above.

(6) A toner binder characterized in that both of a crosslinked polyester having a peak molecular weight of 10,000 or less and a linear polyester having a peak molecular weight of 8,000 or more are used as a binder resin and the molecular weight peak of the linear polyester is larger than the molecular weight peak of the crosslinked polyester.

(7) A toner binder as described in item (6) above, wherein the crosslinked polyester is a polyester resin described in items (1) to (4) above.

(8) A toner comprising the toner binder described in items (1) to (6) above as an essential consistent.

(9) An electrophotographing method and an apparatus therefor comprising developing an electrostatic image with the toner described in item (8) above and transferring and flash fixing the toner image.

DETAILED DESCRIPTION OF THE INVENTION

The constituent element terminated by an ester bond and/or an ether bond to an aliphatic group is described below. In general, a polyester resin is obtained by the following reaction:

$$n(HO—A—OH)+n(HOOC—B—COOH)\rightarrow HO(—A—OCO—B—COO—)_nH+(2n-1)H—O—H$$

In the case where an ether bond is not contained in A or B, the portions A and B are regarded as a constituent element terminated by an ester bond at both ends. Depending on monomers, an ether bond may be present in A or B and in such a case, A or B in the above-mentioned reaction formula has the following structure:

—COO—A—OCO—=—COO—A'—O—A"—OCO—

—OCO—B—COO—=—OCO—B'—O—B"—COO—

When an ether bond is not contained in A', A", B' or B", the portions A', A", B', and B" are regarded as a constituent element terminated by an ester bond and an ether bond.

Further, depending on monomers, A', A", B' or B" may contain an ether bond, but in the same way as above, the portions are classified into either a constituent element terminated by an ester bond and an ether bond or a constituent element terminated by an ether bond at both ends.

The ether bond to an aliphatic group has the following structure:

R—O—A—O—R'

When R and R' each is an aliphatic hydrocarbon group, A is a constituent element terminated by an ether bond to an aliphatic group.

Figure 1A:
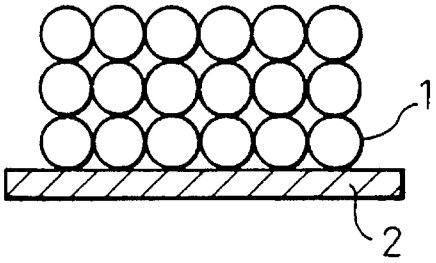
FIGS. 1A to 1C show generation of voids in flash fixing.
Figure 1B:
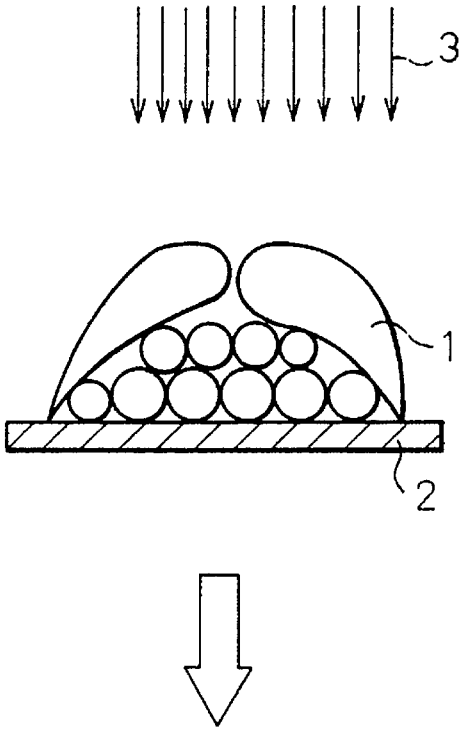
Figure 1C:
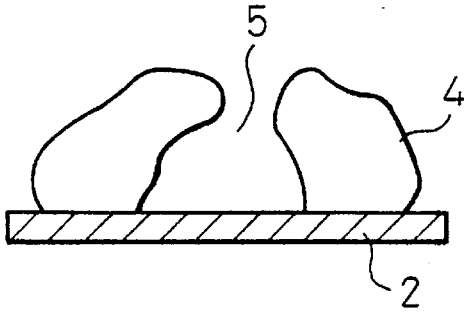
Figure 2:
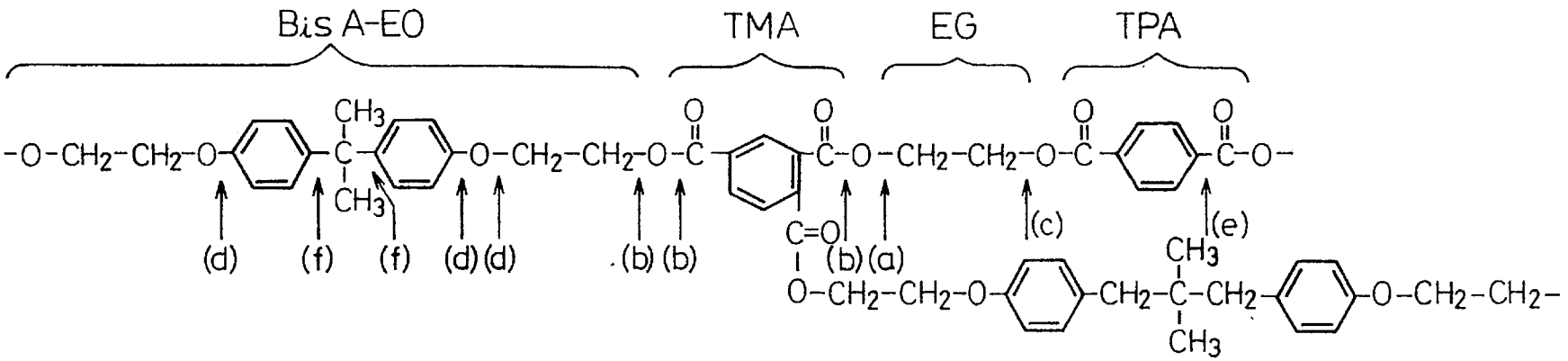
FIG. 2 is a chemical formula showing an example of polyester bonds.

FIG. 2 shows an example of the chemical structure of a polyester resin in which polyoxyethylene (2,2)-2,2-bis(4-hydroxyphenyl)propane (BisA-EO), trimellitic acid (TMA), ethylene glycol (EG) and terephthalic acid are bonded and in this molecular formula. Points ready to undergo thermal decomposition in the above structure are (1) the ester bond ((a), (b)), (2) the ether bond ((c), (d)) and (3) the bond between the benzene ring and the carbon bonded thereto ((e), (f)).

The above-described binders and/or toner compositions (1) to (5) and (8) using the same binder are excellent for a toner for flash fixing because of the following features.

First, by using the above-described toner binders, thermally decomposed gas components are generated in a small amounts even when the toner is melted at high temperatures on flash fixing and, also, since the thermally decomposed gas components have a comparatively mild odor and less of the odorous components are generated, an unpleasant odor is not generated on flash fixing.

More specifically, the present inventors have found that the thermally decomposed gas components generated in flash fixing are largely dependent on the kind of monomers used in the binder and the amounts of the monomers. The thermally decomposed gas components generated on flash fixing can be analyzed using a pyrolytic gas chromatography mass spectrograph (pyrolytic GC-MS), etc. On analysis of the thermally decomposed gas components using the pyrolytic GC-MS, the bonds easily undergoing thermal decomposition can be determined by comparing the molecular structure of the thermally decomposed gas components with that of the polyester. The portions of the "ester bond and/or ether bond to an aliphatic group" as constituent elements of the present invention are bonds which comparatively easily undergo thermal decomposition in the polymer-forming molecular chain. The present inventors have found that the aliphatic hydrocarbon chain terminated by bonds which easily undergo thermal decomposition becomes a functional group of the thermally decomposed gas components and that there is a close relationship between the structure of the aliphatic hydrocarbon chain terminated by an ester bond or an ether bond to an aliphatic group and the fixing odor generated in flash fixing. In other words, in the case where the aliphatic hydrocarbon chain terminated by an ester bond or an ether bond to an aliphatic group contains 3 or more carbon atoms, an unpleasant odor is generated in flash fixing but in the case where the carbon number is 2 or less, i.e., in the case of an ethylene, an unpleasant odor is not detected. Moreover, when the ethylene chain content is from 1 to 5 wt % based on the total amount of the resin, the odor generation is extremely low. The above-described polyester resin is more preferably constituted such that the weight ratio of the aromatic group content to the ethylene chain content is 50 or less.

The polyester resin can have the above-described constituent factors by using, for example, ethylene glycol, diethylene glycol, triethylene glycol or succinic acid as a monomer for constituting the binder. For constituting a polyester using these monomers so that an unpleasant odor is not generated on fixing, it may be constituted to have an ethylene glycol and/or succinic acid content of approximately 10 mol % or more based on the total amount of the monomers. If the ethylene glycol and/or succinic acid content is less than 10 mol %, it provides a toner which generates an unpleasant odor at the fixing step. More preferably, the polyester is constituted to contain polyoxyethylene(2,2)-2,2-bis(4-hydroxyphenyl)propane or polyoxypropylene(2,2)-2,2-bis(4-hydroxyphenyl)propane in an amount of 30 mol % or more.

Other monomers which can be used in the present invention include monomers conventionally used for constituting the polyester resin and examples thereof include an aromatic diol such as polyoxyethylene(2,2)-2,2-bis(4-hydroxyphenyl)propane, polyoxyethylene(4,0)-2,2-bis(4-hydroxyphenyl)propane, polyoxypropylene(2,2)-2,2-bis( 4-hydroxyphenyl)propane, polyoxypropylene(4,0)-2,2-bis(4-hydroxyphenyl)propane, bisphenol A and hydrogenated bisphenol A; and aromatic dicarboxylic acids such as terephthalic acid, isophthalic acid, phthalic acid, phthalic anhydride and an acid anhydride or a lower ester of the above-described dicarboxylic acids, e.g., phthalic anhydride, dimethyl terephthalate, diethyl terephthalate, dimethyl isophthalate, or equivalent products thereof.

Also, aliphatic diols such as 1,2-propylene glycol, 1,3-propylene glycol, 1,3-butanediol, 1,4-butanediol, 1,6-hexanediol, 1,5-pentanediol, octanediol, neopentyl glycol, 2,2-diethyl-1,3-propanediol, 2-butyl-2-ethyl-propanediol, 2,2-diethyl-1,3-propanediol, 2-butyl-2-ethyl-propanediol, 2-butyl-2-ethylpropanediol and polyethylene glycol; an aliphatic dicarboxylic acid such as oxalic acid, malonic acid, adipic acid, maleic acid, fumaric acid, mesaconic acid, itaconic acid and acid anhydrides or lower esters of the foregoing dicarboxylic acids, e.g., maleic anhydride, diethyl maleate, dimethyl maleate, dimethyl fumarate, or equivalent products thereof may be used.

In addition, trivalent or greater polyhydric alcohols such as sorbitol, 1,2,3,6-hexanetetrol, 1,4-sorbitan, pentaerythritol, 1,2,4-butanetriol and trimethylolpropane; and trivalent or greater polyhydric carboxylic acids such as 1,2,4-benzenetricarboxylic acid, 1,2,5-benzenetricarboxylic acid, 1,2,5-hexanetricarboxylic acid and acid anhydrides or lower esters of the foregoing carboxylic acids, or equivalent products thereof may be used.

Among these monomers, the aliphatic diol and the aliphatic dicarboxylic acid are prone to cause generation of an unpleasant odor due to thermal decomposition of a polymer at the fixing step and therefore, the amount thereof is generally 10 wt % or less, preferably 5 wt % or less. They may be used if in the polymer resin, the constituent element consisting of ethylene as the linear aliphatic carbon chain terminated by an ester bond or an ether bond to an aliphatic group is contained in an amount of from 1 to 5 wt % based on the total weight of the resin. The aromatic diol and the aromatic dicarboxylic acid or an equivalent thereof need to be used in an amount of from 40 to 50 wt % in terms of the aromatic ring content so as to obtain a practical glass transition temperature.

In the binder (toner) of the present invention, it is necessary to control the specific molecular weight distribution and the monomer constitution to obtain a practical glass transition point (Tg; in general, 55° C. or higher is considered to be satisfactory) for a toner for flash fixing, good flash fixability and a low odor at the flash fixing step. The Tg of a polymer generally depends on the constituent monomers constituting the polymer, the constituent monomer ratio and the molecular weight distribution. The constituent monomer and the constituent monomer ratio must be controlled in a limited range so as to prevent generation of an unpleasant odor and the molecular weight distribution must be controlled in a limited range so as to obtain flash fixability.

In the binder (toner) of the present invention, as the ethylene chain content ratio as a constituent monomer increases, the amount of odor generated at the flash fixing step falls but Tg decreases. The present inventors have also found that penetration of the binder resin into a recording medium is improved by introducing a constant amount of a methyl chain into the binder molecule chain, thereby further enhancing the fixability of a binder and/or a toner. Further, as a result of investigations by the present inventors, the methyl group bonded to the aliphatic hydrocarbon chain terminated by an ester bond or an ether bond is the methyl side chain which contributes to an improvement in fixability. The present inventors have found that if the methyl side chain content is 1 wt % or more, preferably 3 wt % or more, based on the total weight of the binder resin, the fixability is remarkably improved. Also, according to the investigations by the present inventors, when the side chain to be introduced is a long chain larger than ethyl, the same improvement in fixability may be obtained but the thermally decomposed fragments disadvantageously act as a component which generates an unpleasant odor at the flash fixing step. To support these findings, the present inventors have found that the fixability is improved by replacing polyoxyethylene(2,2)-2,2-bis(4-hydroxyphenyl)propane with an equivalent amount of polyoxypropylene(2,2)-2,2-bis(4-hydroxyphenyl)propane.

The toner binder according to the present invention can be a toner binder and/or a toner having excellent flash fixing, void resistance and environmental properties under the following conditions:

(a) the binder has a number average molecular weight Mn of 5,000 or less, preferably 4,000, (b) the binder has a peak molecular weight Mp of 3,000 or more, preferably 4,000, and (c) the binder has a weight average molecular weight Mw of from 20,000 to 200,000, preferably from 30,000 to 150,000.

A toner binder having such a molecular weight distribution can be achieved in the present invention by using a trifunctional or greater functional polyhydric alcohol or a trifunctional or greater functional polyhydric carboxylic acid which introduces a crosslinked structure. As the high molecular weight content increases, the void resistance is improved. However, if the crosslinking proceeds too much, the relative ratios of the high molecular weight content and the low molecular weight content increase, where the fixability is deteriorated due to the increase in the high molecular weight content and the Tg decreases due to the increase in the low molecular weight content, therefore, it can be understood that the control of crosslinking in a limited range is preferred. With respect to Tg, the molecular weight peak Mp must be 3,000 or more, and if it is lower than this range, the Tg becomes 50° C. or lower, resulting in an impractical toner. With respect to the flash fixability, the weight average molecular weight Mw must be 200,000 or less, preferably 150,000 or less, and if it is larger than this range, the flash fixability is remarkably impaired, resulting in an impractical toner. The Tm is preferably 130° C. or lower. On the other hand, in order to impart void resistance to the toner, the weight average molecular weight Mw may be 20,000 or more. If it is less than this range, void resistance cannot be imparted. The binder having such a molecular weight distribution can be obtained by controlling the amount of the trifunctional or greater functional polyhydric alcohol or the trifunctional or greater functional polyhydric carboxylic acid to fall within the range of from 1 to 10 wt %.

Apart from the above-mentioned method, as a means for increasing the Tg of toner, the present inventors have found that the following toners have a high Tg and a toner for flash fixing having high storage stability can be obtained therefrom.

(6) A toner binder and a toner composition thereof for use in an electrophotographic apparatus with a flash fixing device, wherein a crosslinked polyester having a peak molecular weight of 10,000 or less and a linear polyester having a peak molecular weight of 8,000 or more both are used as a binder resin and the molecular weight peak of the linear polyester is larger than the molecular weight peak of the crosslinked polyester.

(7) A toner binder wherein the crosslinked polyester is a polyester resin described in items (1) to (5).

The toner using the above-mentioned toner binder is superior in storage stability, and as a toner for flash fixing, because of the following features.

Figure 3:
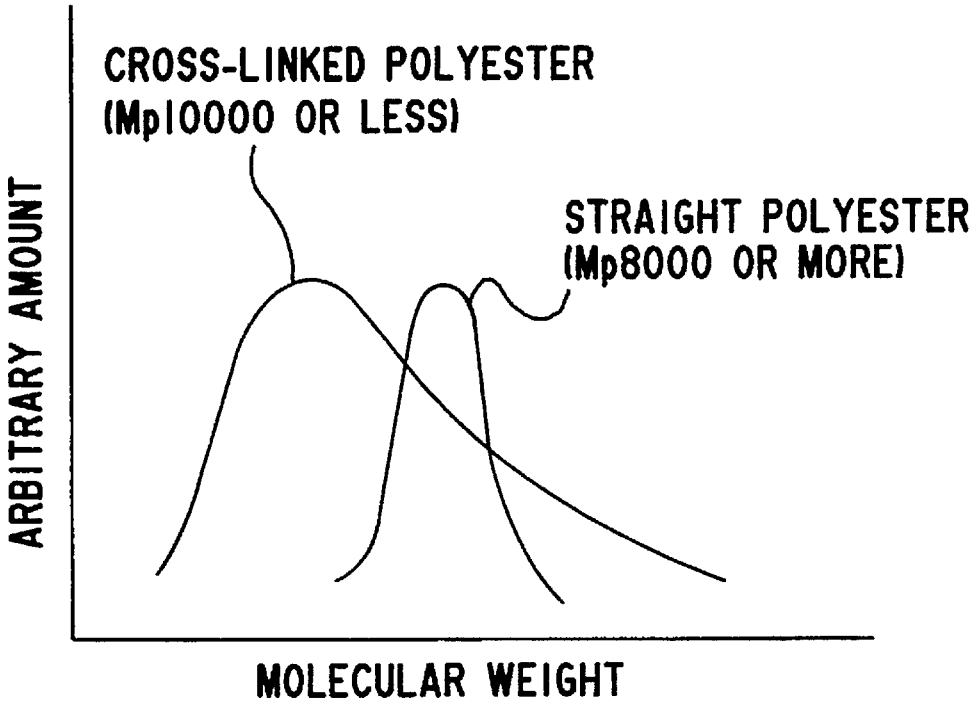
FIG. 3 is a conceptual view of a polymer blend according to the present invention.

First, in the above-mentioned toner binders, the linear polyester having a peak molecular weight of 8,000 or more has a high Tg and therefore, the toner can have a high Tg. With respect to the linear polyester, it is preferred to use a polymer having an extremely narrow Mw distribution width of 20,000 or less. However, since the linear polyester has a low viscosity, when the linear polyester binder is used alone, voids are readily generated on a fixed image in flash fixing and a high quality fixed image, for example, a fixed image of OD 1.3 or more cannot be obtained. A high quality fixed image can be obtained by using a crosslinked polyester having a peak molecular weight of 10,000 or less together with the above-mentioned linear polyester. At this time, both of a high Tg performance of the linear polyester and a high quality fixed image performance of the crosslinked polyester can be obtained simultaneously only when the peak molecular weight of the linear polyester is larger than the peak molecular weight of the crosslinked polyester. The method for obtaining a toner having a high Tg by blending binders has little influence on the void resistance and the flash fixability as compared to the method of controlling the peak molecular weight of a binder, therefore, it ensures void resistance, flash fixability and storage stability on higher levels. FIG. 3 illustrates the relationships of this blending.

The blending ratio of the linear polyester and the crosslinked polyester is a parameter which should be determined by the Tg of the linear polyester and the void resistance of the crosslinked polyester but the linear polyester is preferably contained in an amount of about 20 wt % or more and the crosslinked polyester is approximately 50 wt % or more.

Further, the use of the polyester resin described in items (1) to (4) as the crosslinked polyester provides a toner which has low fixing odor and is excellent in storage stability and flash fixability.

By constituting the binder and/or toner of the present invention to have the above-described features, the objects (1) of preventing generation of a fixing odor at the flash fixing step, (2) of ensuring flash fixability, (3) of achieving void resistance and (4) of being high in storage stability, can be attained.

Although the above-described polyester polymers can be used solely as a toner binder, it may be used in combination with other binders, if desired. In the case of a combined use with other binders, the binder to be blended may be those conventionally used for a toner and for example, polyester resins other than the present invention, epoxy or polyamide may be used. However, according to the findings of the present inventors, blending with styrene or styrene acrylic resin is not preferred because a large amount of styrene or xylene as thermally decomposed gas components is generated at the flash fixing step. In the case of a combined use with other binder, the polyester polymer of the present invention is used in an amount of 50 wt % or more based on the total amount of the binder resin. If the use amount is less than 50 wt %, excellent flash fixing, void resistance and heat stability ascribable to the polyester polymer of the present invention are lost.

The binder resin used in the present invention can be produced by conventionally known methods. Specifically, it can be produced by adding an acid or a lower alkyl ester of an acid and an alcohol, if desired, in the presence of a tin, titanium or nickel organic compound as a catalyst and then subjecting the mixture to condensation reaction at a temperature of from 150° to 300° C.

The toner used in the present invention can be produced by conventionally known methods. Specifically, a binder resin, a coloring agent and if desired, carbon and a charge regulator are melt kneaded in a press kneader, a roll mill or an extruder to obtain a uniform dispersion, then finely pulverized by a jet mill and classified by a classifier such as a pneumatic classifier to obtain a desired toner.

In a representative composition of a toner for flash fixing, the binder resin contains carbon as a pigment or a charge-imparting agent in an amount of from 0.5 to 10 wt %, an electrostatic charge controlling agent in an amount of from 0.5 to 5 wt % and, if desired, other additives such as wax, magnetic powder, and the rest is a binder (usually, from 80 to 99 wt %). The particle diameter of the toner is generally from 1 to 20 μm.

The above-described binder and/or toner for flash fixing provides excellent flash fixing, low odor, excellent void resistance and excellent stability when it is used in a developer for use in an electrophotographic apparatus with a flash fixing device. Among these excellent properties, the low odor becomes an important feature as the printing speed of the electrophotographic apparatus becomes higher. The low odor depends on the melting amount of the toner per unit hour, and it becomes an important point not only in the case where the user continuously prints a solid image as a printing pattern but also in an apparatus having a high printing speed in which the amount of toner melted per unit hour is large. In the case of printing a normal printing pattern (where the ratio of the area attached by a toner per unit hour/the whole paper area coming under printing per unit hour [printing ratio] is about 0.05), it becomes an important performance in an electrophotographic apparatus having a print speed of 300 mm/sec. At this printing speed, the amount of toner melted per unit hour is about 100 g/hour. In a printer where a large amount of toner is melted/fixed per unit hour, it provides an odor much lower than commercially available toner (a toner for heat roll fixing).

Figure 4:
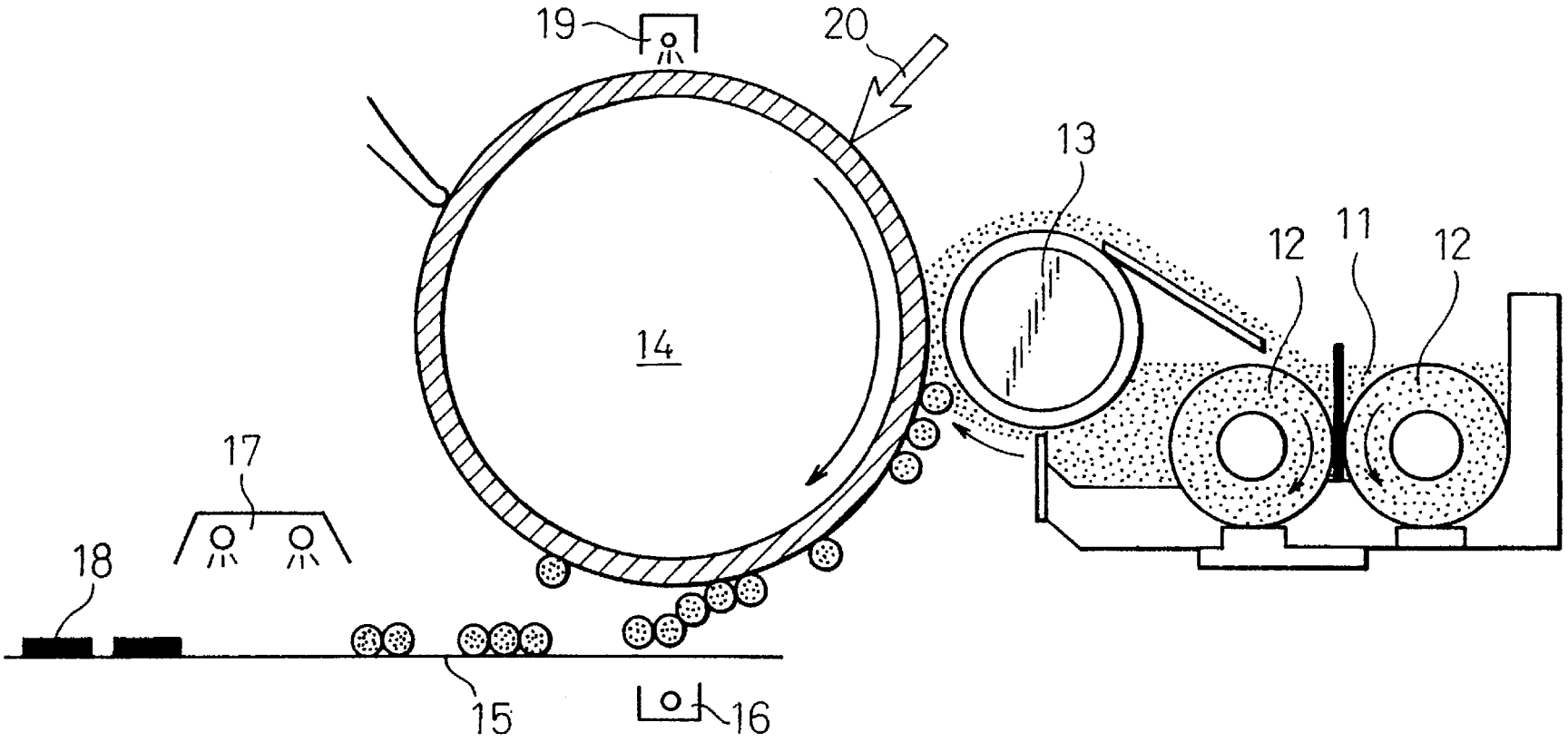
FIG. 4 shows the flash fixing.

The toners described in items (1) to (8) above are preferably used, for example, in an electrophotographic apparatus as shown in FIG. 4. A toner described in one of items (1) to (8) above is used and mixed, for example, with a magnetic powder such as an iron powder for the use as a developer. The mixing ratio of the toner with the magnetic powder is commonly on the order of from 1 to 20 wt %. When the developer 11 is mixed and stirred by stirring screws 12, the toner is charged by friction. The developer charged by friction is transported to the surface of a photosensitive drum 14 by a developing roller 13 and the charged toner adheres to the photosensitive drum in accordance with an electrostatic image pattern on photosensitive drum 14 to form a visible image. The toner image on the drum 14 is transferred to a recording medium 15 such as paper and the toner image is heated and melted by a flash light 17 so that the toner penetrates into the paper, providing a fixed image 18. Note that in FIG. 4, 16 is a transferring portion, 19 is a pre-charging means and 20 is an exposure portion.

The above-described printing method and electrophotographic system are excellent owing to the characteristics described below. First, the fixing system is flash fixing and therefore, the following advantages can be provided:

1) due to non-contact fixing, the resolution of a developed image is not deteriorated,
2) the stand-by time after a power source is turned on is not required and a quick start can be realized,
3) even when recording paper is jammed in the fixing device due to a system failure, ignition does not occur, and
4) fixing is possible irrespective of the material or the thickness of the recording paper, such as pasted paper, preprint paper or papers of different thickness. Further, since the binder/toner described in one of items (1) to (8) is used, an unpleasant odor is not generated during flash fixing and the odor is low. Also, a high quality fixed image having excellent flash fixability and superior void resistance can be achieved. The storage stability is also excellent.

The values of various physical properties set forth in the present invention are determined according to the measurement methods described below.

Melting Point (Softening Point)

The melting point was measured using a flow tester (Shimadzu Flow Tester CFT-500, manufactured by Shimadzu Seisakusho). A temperature rising flow test was conducted under the following conditions and the temperature when the plunger descended by 4 mm was determined as the melting point.

| | |
|---|---|
| Die | 1.0 mm × 1.0 mmϕ |
| Temperature up rate | 6° C./min |
| Sample | 1.5 g of pellets |
| Load | 20 kg/cm$^2$ |
| Preheating temperature | 60° C. |
| Preheating time | 300 sec |

Glass Transition Point (Tg)

The glass transition point Tg was measured using a differential scanning calorimeter (DSC-20, manufactured by Seiko Denshi KK) and determined from the high temperature endothermic curve at a temperature increase rate of 5° C./min. As a pretreatment for the measurement, 10 mg of a sample was placed in a metal holder, left on a hot plate at 170° C. for 5 minutes and cooled naturally to room temperature without quenching it. The measurement temperature is from 30 to 100° C.

Molecular Weight Distribution

The molecular weight distribution was measured using an apparatus equipped with a column (Tosoh Corp., CMH×3 columns) in a gel permeation chromatograph (GPC) in such a manner that a sample was dissolved in tetrahydrofuran (THF) at a concentration of 0.2 wt % and the measurement was conducted at a flow rate of 1 ml/min at a temperature of 20° C. In the measurement of the molecular weight distribution of a sample, the measurement condition was selected such that the molecular weight of the sample is included in a range where the logarithm of the molecular weight and the count number on a calibration curve prepared by several monodisperse polystyrene standard samples is linear.

The present invention is described below in greater detail by referring to the examples but the present invention is by no means limited to these.

EXAMPLES

Example 1

A polyester resin 1 comprising a combination of as diols 29.1 parts by weight (22 mol %) of polyoxyethylene (2,2)-2,2-bis(4-hydroxyphenyl)propane, 31.6 parts by weight (22 mol %) of polyoxypropylene(2,2)-2,2-bis(4-hydroxyphenyl-)propane and 2.9 parts by weight (11 mol %) of ethylene glycol, as an acid 32.4 parts by weight (40 mol %) of dimethyl terephthalate and as a trifunctional and carboxylic acid 4.0 parts by weight of trimellitic acid anhydride was prepared. Using the polyester resin thus obtained, a toner was prepared and evaluated in accordance with the following method.

90 parts by weight of the binder, 7 parts by weight of carbon black (Black Pearls L, produced by Cabot) as a coloring agent and 3 parts by weight of a nigrosine dye (Oil Black BY, produced by Orient Chemical Co.) as an electrostatic charge controlling agent were mixed and melt-kneaded using a press kneader at 130° C. for 30 min to obtain a toner mass. After cooling, the toner mass was pulverized by a ROTOPLEX pulverizer into a coarse toner having a particle size of about 2 mm. Then, the coarse toner was finely pulverized by a jet mill (PJM pulverizer, manufactured by Nippon Pneumatic Industry K.K.) and the pulverized product was classified by a pneumatic classifier (Alpine Co.) to obtain the positively charged toner 1 having a particle size of from 5 to 20 μm. A developer comprising 5 parts by weight of the toner thus prepared and 95 parts by weight of an amorphous iron powder (TSV100/200, produced by Powdertec K.K.) as a carrier was prepared.

In order to evaluate flash fixability of the toner, a 5 mm-square solid image was printed using a laser printer (F6700D, manufactured by Fujitsu Ltd.) employing a flash fixing system and then a tape peeling test was conducted thereon. In the fixing device a 160 μF-capacitance condenser was used and a charging voltage of 2,000 V was applied to the flash lamp. The toner layer thickness of the solid image on the recording medium was about 15 μm. The tape peeling test was conducted in such a manner that a pressure sensitive adhesive tape (Scotch Mending Tape, produced by Sumitomo 3M KK) was lightly affixed to the solid image portion, an iron-made cylindrical block having a diameter of 100 mm and a thickness of 20 mm was rolled at a constant speed on the tape in contact with the recording medium and then the tape was peeled off from the recording medium. As the index for fixability, the fixability was determined to be good or bad from the ratio (percentage) of the optical image density (OD) after the peeling of tape to the density before the peeling. When the ratio is 80% or more, the fixability rated good. The optical image density was measured using a PCM meter (manufactured by Macbeth KK). In this example, the fixability was as good as 96%.

The state of the voids formed in the fixed image was determined by the ratio of the black portion (part covered by toners) to the white portion (part not covered by toners) on a photograph of a solid portion of a flash fixed image, which was taken through a microscope and image processed. When the black part accounted for 90% or more, the state rated good. In this example, the covering ratio of toner was 95% and OD was 1.34, thus the state was good.

The heat stability of the toner was determined in such a manner that 20 g of the toner was charged to a polyethylene bottle and exposed to an environment of 55° C. and 30% RH for 12 hours, toners smaller than 200 meshes (75 μm) removed and then the heat stability was evaluated by the remaining toner weight. The remaining toner weight of 10 wt % or less rated good. In this example, no the toner remained on the mesh, thus, the heat stability was good.

In order to evaluate the sample for unpleasant odor in the flash fixing step, the charging voltage in the fixing device was raised to 2,200 V and applied to the flash lamp. The toner thickness of a solid image on the recording medium was controlled to about 15 μm (the condition that about 200 g of the toner is melted/fixed per 1 hour) and the fixing odor generated from the fixing device was evaluated by a sensory manner in the state where a continuous printing of 200 to 300 sheets was conducted. The sensed odor was evaluated into 5 grades according to the following evaluation criteria.

1: A level where almost no odor is detected.

2: A level where an odor is detected but not disturbing.

3: A level where an odor is detected and causes an unpleasant feeling when present for a long period of time.

4: A level where a same odor is detected and causes an unpleasant feeling in a short time.

5: A level where a strong odor is detected.

In the present invention, an odor on level 2 (where an odor is sensible but not disturbing), or lower than that, is rated good. As a result of the sensory evaluation, the fixing odor of this example was at level 1, which raised no problem.

Example 2

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, terephthalic acid, isophthalic acid, succinic acid and trimellitic acid were used as starting monomers for a polyester resin. As a result of evaluation, no fixing odor was sensed at all and was at level 1, the fixability was 95% and OD was 1.32 and, thus, good results were obtained. Also, the storage stability was good.

Example 3

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, diethylene glycol, terephthalic acid and trimellitic acid were used as starting monomers for a polyester resin. The fixing odor was not sensed and was at level 1. The fixability was 95% and the OD was 1.35. The storage stability was 5% or less and was good.

Example 4

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, diethylene glycol, terephthalic acid, isophthalic acid and trimellitic acid were used as starting monomers for a polyester resin. The fixing odor was at level 1 and was good. The fixability was 100% and the OD was 1.39, thus, the results were good. Also, the storage stability was good.

Example 5

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, 1,2-propylene glycol, ethylene glycol, dimethyl terephthalate and trimellitic acid were used as starting monomers for a polyester resin. The fixing odor was at level 2 and an odor was detected but caused no problem. The fixability was nearly 100% and the OD was 1.30, thus, the results were good. The storage stability was 5% and was good.

Example 6

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, neopentyl glycol, diethylene glycol, terephthalic acid, isophthalic acid and trimellitic acid were used as starting monomers for a polyester resin. The fixing odor was at level 2 and a fixing odor was detected but no problem was caused thereby. The fixability was nearly 100% and the OD was 1.30, thus, the results were good. The storage stability was 0% and was good.

Example 7

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, 1,2-propylene glycol, ethylene glycol, dimethyl terephthalate, fumaric acid and trimellitic acid were used as starting monomers for a polyester resin. The fixing odor was at level 2 and a rubbery odor was detected but no problem was caused therefrom. The fixability was 100% and the OD were 1.35, thus, good results were obtained. The storage stability was 5% or less.

Example 8

A sample was prepared and evaluated in the same manner as in Example 1 except that 50 parts by weight of the polyester resin described in Example 4 and 40 parts by weight of epoxy resin (Epiclon EXA-1191, produced by Dainippon Ink & Chemicals, Inc.) were used. A fixing odor was detected but was at level 2 and caused no problem. The fixability was 100% and the OD was 1.38, thus, good results were obtained. The storage stability was 0%.

Example 9

A sample was prepared and evaluated in the same manner as in Example 1 except that 60 parts by weight of the polyester resin described in Example 3 and 30 parts by weight of the polyester described in Comparative Example 5 were used. A fixing odor was not sensed at all and was at level 1. The fixability was 100% and the OD was 1.40, thus, a very high quality image was obtained. The storage stability was 5% or less.

Example 10

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, terephthalic acid and isophthalic acid were used as starting monomers for a polyester resin. The fixing odor was on level 4 and a strong rubbery odor was generated which was an unpleasant odor on a level giving unpleasant feeling in a short period of time. The fixability was about 95% and the OD was 1.18 (image covering ratio: 60%), thus, a good image was not obtained. The storage stability was 5% or less.

Example 11

A sample was prepared and evaluated in the same manner as in Example 1 except that polyoxypropylene(2,2)-2,2-bis(4-hydroxyphenyl)propane, ethylene glycol, dimethyl terephthalate and succinic acid were used as starting monomers for a polyester resin. The fixing odor was on level 1, the fixability was 95% and the OD was about 1.32, thus no problem was raised with respect to these properties, but the storage stability was 20% or more and problematic.

Example 12

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, neopentyl glycol, terephthalic acid, dimethyl terephthalate, succinic acid and trimellitic acid were used as starting monomers for a polyester resin. The fixing odor was on level 4 and a strong and sweet odor was generated to give unpleasant feeling often a long period of time. The fixability was 100% and the OD 1.38, thus, a high quality image could be obtained. The storage stability was 5% or less.

Example 13

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, 1,2-propylene glycol, ethylene glycol, diethylene glycol, terephthalic acid, isophthalic acid and trimellitic acid were used as starting monomers for a polyester resin. The fixing odor was at level 2. The fixability was 60% and the OD was 1.35, thus, the fixability was problematic. The storage stability was 5% or less.

Example 14

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, neopentyl glycol, diethylene glycol, terephthalic acid and trimellitic acid were used as starting monomers for a polyester resin. The fixing odor was at level 2. The fixability was 100% and the OD was 1.20 (image covering ratio: 70%), thus a good image was not obtained. The storage stability was 5%.

Example 15

A sample was prepared and evaluated in the same manner as in Example 1 except that polyoxyethylene(2,2)-2,2-bis(4-hydroxyphenyl)propane, polyoxypropylene(2,2)-2,2-bis(4-hydroxyphenyl)propane, diethylene glycol, terephthalic acid, fumaric acid and trimellitic acid were used as starting monomers for a polyester resin. The fixing odor was at level 3 and a burned rubber odor was generated to give unpleasant feeling after a long period of time. The fixability was 50% and the OD was 1.30, thus the fixability was problematic. The storage stability was 0%.

Example 16

A sample was prepared and evaluated in the same manner as in Example 1 except that 90 parts by weight of the epoxy resin described in Example 7 was used. The fixing odor was at level 3 and a slightly sweet odor was generated to give unpleasant feeling after a long period of time. The fixability was 100% and the OD was about 1.28, thus, a good image was obtained. The storage stability was 0%.

Example 17

A sample was prepared and evaluated in the same manner as in Example 1 except that 20 wt % of a linear polyester prepared in the same manner as the binder used in Example 1 except for using polyoxyethylene(2,2)-2,2-bis(4-hydroxyphenyl)propane, polyoxypropylene(2,2)-2,2-bis(4-hydroxyphenyl)propane and terephthalic acid as starting monomers, and 70 wt % of the binder used in Example 5, were used. The fixing odor was at level 2 which was almost equivalent to the level for the toner described in Example 5. The fixability was nearly 100% and the OD was 1.3, thus, the results were good. The storage stability was 0% which was superior to that of toner in Example 5.

Example 18

A sample was prepared and evaluated in the same manner as in Example 1 except that 40 parts by weight of a linear polyester prepared in the same manner as in Example 1 except for using polyoxyethylene(2,2)-2,2-bis(4-hydroxyphenyl)propane, polyoxypropylene(2,2)-2,2-bis(4-hydroxyphenyl)propane, terephthalic acid and trimellitic acid as starting monomers and 40 parts by weight of the binder used in Example 11 were used. The fixing odor was at level 1. The fixability was nearly 100% and the OD was 1.32, thus, the results were good. The storage stability was 0%, and thus was better than the storage stability of Example 11.

The monomer compositions and physical properties of binders prepared above and the toner properties when a toner was formed using these binders are shown in Tables 1-1 to 1-4. In these tables, EO represents polyoxyethylene(2,2)-2,2-bis(4-hydroxyphenyl)propane, PO represents polyoxypropane(2,2)-2,2-bis(4-hydroxyphenyl)propane, EG represents ethylene glycol, DEG represents diethylene glycol, 12PG represents 1,2-propylene glycol, NPG represents neopentyl glycol, TPA represents terephthalic acid, IPA represents isophthalic acid, DMT represents dimethyl terephthalate, SA represents succinic acid, FA represents fumaric acid, TMA represents trimellitic acid (these all are monomer), —$C_2H_4$—represents ethylene, —$C_6H_4$—represents phenylene, $C_6H_4/C_2H_4$ represents the molar ratio of phenylene to ethylene and —$CH_3$ represents methyl.

First, it is apparent that the fixing odor generated in flash fixing depends on the ethylene amount contained in the binder. In other words, the toner using the binder which contains from 1 to 5 wt %, based on the total weight of the resin, of a constituent element in which the aliphatic carbon chain terminated by an ester bond and/or an ester bond to an aliphatic group consists of ethylene, emits less odor (binders and/or toners of Examples 1 to 9, 11, 13, and 14). Further, although when 1,2-propylene glycol, 1,3-propylene glycol, neopentyl glycol or fumaric acid is contained, a strong unpleasant odor is generated (Example 12), the toner of further containing ethylene glycol and/or succinic acid emits odor reduced to some degree (Examples 5, 6, and 7). However, even when ethylene glycol and/or succinic acid is contained, if other aliphatic diols or other aliphatic dicarboxylic acids are contained in an amount of 10 wt % or more, an unpleasant odor is generated (Example 12).

The flash fixability depends on the weight average molecular weight Mw of the binder and the toner having a weight average molecular weight Mw exceeding 200,000 (Example 15) is low in flash fixability. Also, the OD depends on the weight average molecular weight of the binder and the toner having a weight average molecular weight of 20,000 or less (Examples 10 and 14) is low in void resistance, has an image covering ratio of approximately from 60 to 70% and as a result, could only have a low OD.

The storage stability depends on the Tg of the binder and the toner having a Tg of 55° C. or lower (Example 11) is problematic. When the molecular weight peak Mp is made large, the Tg becomes high and therefore, by giving Mp of 3,000 or more, the Tg of 55° C. or higher can be achieved.

A toner in which a linear polyester is blended with a crosslinked polyester to give the toner a Tg of 55° C. or higher (Examples 17 and 18) is excellent in storage stability. Among toners using a linear polyester and a crosslinked polyester in combination, the toner using a binder which generates a low odor and is excellent in flash fixability (Examples 1 to 9) as a crosslinked polyester (Example 17) gives a low fixing odor and is excellent in flash fixability and also in storage stability.

TABLE 1-1

| | Example | | | | | | | | |
|---|---|---|---|---|---|---|---|---|---|
| | 1 | 2 | 3 | 4 | 5 | 6 | 7 | 8 | 9 |
| EO | 29.3 | 39.2 | 18.0 | | 23.6 | 32.9 | 27.6 | Epoxy + | Binder |
| PO | 32.2 | 33.3 | 50.7 | 63.7 | 25.9 | 23.0 | 30.3 | binder | of |
| EG | 2.8 | | | | 3.3 | | 5.9 | of | Ex. 3 + |
| DEG | | | 4.2 | 5.2 | | 5.4 | | Ex. 4 | Binder |
| 12PG | | | | | 5.9 | | 1.4 | | of |
| NPG | | | | | | 3.8 | | | Ex. 14 |
| TPA | | 10.3 | 21.0 | 14.9 | | 22.9 | | | |
| IPA | 8.4 | | 6.8 | | 7.6 | | | | |
| DMP | 31.8 | | | | 38.5 | | 24.8 | | |
| SA | | 5.1 | | | | | | | |
| FA | | | | | | | 2.7 | | |

TABLE 1-1-continued

| | Example | | | | | | | | | |
|---|---|---|---|---|---|---|---|---|---|---|
| | 1 | 2 | 3 | 4 | 5 | 6 | 7 | 8 | exit | 9 |
| TMA | 3.9 | 3.7 | 6.1 | 9.4 | 2.8 | 4.4 | 7.3 | | | |
| —$C_2H_4$— | 2.0 | 2.0 | 2.7 | 2.9 | 2.2 | 3.7 | 3.5 | | | |
| —$C_6H_4$— | 46.7 | 45.5 | 44.7 | 43.7 | 44.2 | 44.2 | 42.9 | | | |
| $C_6H_4/C_2H_4$ | 23.4 | 22.7 | 16.7 | 14.9 | 20.2 | 12.0 | 12.3 | | | |
| —$CH_3$ | 3.4 | 3.3 | 5.0 | 6.3 | 4.1 | 3.5 | 3.5 | | exit | |

Note:
The composition of starting monomers in the Table is in units of parts by weight.

TABLE 1-2

| | Example | | | | | | | | | |
|---|---|---|---|---|---|---|---|---|---|---|
| | 10 | 11 | 12 | 13 | 14 | 15 | 16 | 17 | | 18 |
| EO | 34.1 | | 30.8 | 58.5 | 28.7 | 31.7 | Epoxy | 19.5 | 19.7 | |
| PO | 37.3 | 50.9 | 25.3 | 7.6 | 31.5 | 38.8 | | 49.8 | 50.4 | |
| EG | | | | 1.3 | | | | | | |
| DEG | | 12.6 | | 2.3 | 2.3 | 1.2 | | | | |
| 12PG | | | | 1.0 | | | | | | |
| NPG | | | 11.3 | | 5.1 | | | | | |
| TPA | 20.0 | | 9.4 | 15.9 | 31.6 | 13.9 | | 30.7+ | 29.8 | Binder of Ex. 11 |
| IPA | 8.6 | | | 6.8 | | | | Binder | | |
| DMP | | 22.2 | 9.2 | | | | | of | | |
| SA | | 7.9 | 6.7 | | | | | Ex. 5 | | |
| FA | | | | | | 3.9 | | | | |
| TMA | 6.4 | 7.3 | 6.6 | 0.8 | 10.5 | | | | 0.1 | |
| —$C_2H_4$— | 0.6 | 9.6 | 2.3 | 3.0 | 1.9 | 1.3 | | 0.4 | | 0.4 |
| —$C_6H_4$— | 48.0 | 37.0 | 39.4 | 46.5 | 44.8 | 44.7 | | 47.6 | | 47.5 |
| $C_6H_4/C_2H_4$ | 76.5 | 3.9 | 17.0 | 15.5 | 24.0 | 34.9 | | 132.0 | | 130.7 |
| —$CH_3$ | 3.7 | 5.3 | 6.1 | | 4.7 | 3.8 | | 5.0 | | 5.0 |

TABLE 1-3

| | Example | | | | | | | | |
|---|---|---|---|---|---|---|---|---|---|
| | 1 | 2 | 3 | 4 | 5 | 6 | 7 | 8 | 9 |
| Tm | 121 | 125 | 123 | 125 | 116 | 123 | 126 | | |
| Tg | 61 | 63 | 59 | 58 | 56 | 58 | 59 | | |
| Mn | 2800 | 3000 | 3000 | 4100 | 2500 | 3000 | 3000 | | |
| Mp | 5000 | 5200 | 5000 | 5500 | 4500 | 5000 | 5500 | | |
| Mw | 52000 | 72000 | 50000 | 120000 | 25000 | 40000 | 75000 | | |
| AV | 3.5 | 3.8 | 7.3 | 7.7 | 3.6 | 2.8 | 8.9 | | |
| Fixing odor | ◎ | ◎ | ◎ | ◎ | ○ | ○ | ○ | ○ | ◎ |
| Fixability | ○ | ○ | ○ | ◎ | ◎ | ◎ | ◎ | ◎ | ◎ |
| OD | ◎ | ○ | ◎ | ◎ | ○ | ○ | ○ | ◎ | ◎ |
| Stability | ○ | ◎ | ○ | ○ | ○ | ○ | ○ | ◎ | ○ |

TABLE 1-4

| | 10 | 11 | 12 | 13 | 14 | 15 | 16 | 17 | 18 |
|---|---|---|---|---|---|---|---|---|---|
| Tm | 126 | 118 | 125 | 119 | 120 | 131 | | 125 | |
| Tg | 60 | 50 | 62 | 59 | 61 | 63 | | 68 | |
| Mn | 4000 | 2500 | 3000 | 3000 | 3000 | 4000 | | | |
| Mp | 8500 | 6500 | 8000 | 7000 | 8000 | 9500 | | 10500 | |
| Mw | 12000 | 48000 | 65000 | 32000 | 12000 | 250000 | | | |
| AV | 9.2 | 5.3 | 14.7 | 6.1 | 2.5 | 9.8 | | 8.0 | 5.7 |
| Fixing odor | x | ◎ | x | ○ | ○ | Δ | x | | |
| Fixability | ○ | ○ | ○ | x | ◎ | x | ◎ | | |
| OD | x | ○ | ○ | ○ | x | ◎ | ○ | | |
| Stability | ○ | x | ○ | ○ | ○ | ○ | ○ | | |

What is claimed is:

1. A toner binder comprising a polyester resin comprising, as a constituent element, ethylene as a liner aliphatic hydrocarbon chain terminated by (i) an ether bond bonded to an aromatic group and/or (ii) an ester bond, in an amount of 1 to 5% by weight based on the total weight of the polyester resin.

2. The toner binder as claimed in claim 1, wherein said polyester resin has a weight ratio of aromatic rings to ethylene chains of 50 or less.

3. The toner binder as claimed in claim 1, wherein said polyester resin has an acid value of from 1 to 10 KOHmg/g.

4. The toner binder as claimed in claim 1, wherein said polyester resin contains methyl side chains bonded to the aliphatic hydrocarbon chain terminated by an ester bond and/or an ether bond to the benzene ring in an amount of 1 wt % or more based on the total weight of the resin.

5. The toner binder as claimed in claim 1 which comprises said polyester resin in an amount of from 50 to 90 wt %.

6. A toner binder comprising both of a crosslinked polyester having a peak molecular weight of 10,000 or less and a linear polyester having a peak molecular weight of 8,000 or more as binder resins, the linear polyester having a molecular weight peak larger than that of the crosslinked polyester.

7. The toner binder as claimed in claim 6, wherein said crosslinked polyester is a polyester resin described in claim 1.

8. The toner binder as claimed in claim 6, wherein said crosslinked polyester is a polyester resin described in claim 2.

9. The toner binder as claimed in claim 6, wherein said crosslinked polyester is a polyester resin described in claim 3.

10. The toner binder as claimed in claim 6, wherein said crosslinked polyester is a polyester resin described in claim 4.

11. A toner comprising a toner binder described in claim 1 as an essential constituent element.

12. A toner comprising a toner binder described in claim 2 as an essential constituent element.

13. A toner comprising a toner binder described in claim 3 as an essential constituent element.

14. A toner comprising a toner binder described in claim 4 as an essential constituent element.

15. A toner comprising a toner binder described in claim 6 as an essential constituent element.

16. An electrophotography process comprising developing an electrostatic image using a toner described in claim 11 to form a toner image and transferring and flash fixing the toner image.

17. An electrophotography process comprising developing an electrostatic image using a toner described in claim 12 to form a toner image and transferring and flash fixing the toner image.

18. An electrophotography process comprising developing an electrostatic image using a toner described in claim 13 to form a toner image and transferring and flash fixing the toner image.

19. An electrophotography process comprising developing an electrostatic image using a toner described in claim 14 to form a toner image and transferring and flash fixing the toner image.

20. An electrophotography apparatus which develops an electrostatic image using a toner described in claim 11 to form a toner image and transfers and flash fixes the toner image.

21. An electrophotography apparatus which develops an electrostatic image using a toner described in claim 12 to form a toner image and transfers and flash fixes the toner image.

22. An electrophotography apparatus which develops an electrostatic image using a toner described in claim 13 to form a toner image and transfers and flash fixes the toner image.

23. An electrophotography apparatus which develops an electrostatic image using a toner described in claim 14 to form a toner image and transfers and flash fixes the toner image.

* * * * *